US008118644B2

(12) United States Patent
Kulp et al.

(10) Patent No.: US 8,118,644 B2
(45) Date of Patent: Feb. 21, 2012

(54) CHEMICAL MECHANICAL POLISHING PAD HAVING INTEGRAL IDENTIFICATION FEATURE

(75) Inventors: Mary Jo Kulp, Newark, DE (US); Darrell String, Havre de Grace, MD (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 750 days.

(21) Appl. No.: 12/252,820

(22) Filed: Oct. 16, 2008

(65) Prior Publication Data

US 2010/0099336 A1 Apr. 22, 2010

(51) Int. Cl.
*B24B 1/00* (2006.01)

(52) U.S. Cl. ..... 451/41; 451/56; 451/527

(58) Field of Classification Search ..... 451/6, 56, 451/41, 527, 539

See application file for complete search history.

(56) References Cited

U.S. PATENT DOCUMENTS

| | | | | |
|---|---|---|---|---|
| 2,288,625 | A * | 7/1942 | Holmsten | 451/539 |
| 4,193,671 | A | 3/1980 | Erickson et al. | |
| 4,437,269 | A * | 3/1984 | Shaw | 451/490 |
| 5,102,169 | A | 4/1992 | Mayfield | |
| 5,533,923 | A | 7/1996 | Shamouillan et al. | |
| 5,584,146 | A | 12/1996 | Shamouillan et al. | |
| 5,605,760 | A | 2/1997 | Roberts | |
| 5,918,341 | A * | 7/1999 | Hale | 15/209.1 |
| 6,090,475 | A * | 7/2000 | Robinson et al. | 428/212 |
| 6,106,661 | A | 8/2000 | Raeder et al. | |
| 6,136,043 | A * | 10/2000 | Robinson et al. | 8/485 |
| 6,168,508 | B1 | 1/2001 | Nagahara et al. | |
| 6,257,098 | B1 | 7/2001 | Cirone | |
| 6,264,533 | B1 * | 7/2001 | Kummeth et al. | 451/8 |
| 6,599,177 | B2 * | 7/2003 | Nevoret et al. | 451/526 |
| 6,685,537 | B1 | 2/2004 | Fruitman et al. | |
| 6,752,690 | B1 * | 6/2004 | Fruitman | 451/6 |
| 7,018,581 | B2 | 3/2006 | David et al. | |
| 7,108,596 | B2 * | 9/2006 | Nevoret et al. | 451/526 |
| 2002/0077037 | A1 * | 6/2002 | Tietz | 451/41 |
| 2007/0298697 | A1 * | 12/2007 | Charmoille et al. | 451/425 |
| 2008/0004743 | A1 | 1/2008 | Goers et al. | |
| 2011/0021114 | A1 * | 1/2011 | McArdle et al. | 451/8 |

FOREIGN PATENT DOCUMENTS

GB 2345657 A 7/2000

* cited by examiner

*Primary Examiner* — Maurina Rachuba
(74) *Attorney, Agent, or Firm* — Thomas S. Deibert

(57) ABSTRACT

Chemical mechanical polishing pads having a polishing layer with a polishing surface adapted for polishing a substrate are provided, wherein the polishing layer has a unique integral identification feature; wherein the unique integral identification feature is non-polish active, wherein the unique integral identification feature comprises at least two visually distinct characteristics, wherein at least one of the at least two visually distinct indicia is a non-color based indicia, wherein one of the at least two visually distinct indicia is a color based indicia, and wherein the at least two visually distinct characteristics are selected to uniquely identify the chemical mechanical polishing pad as a type of chemical mechanical polishing pad selected from a plurality of types of chemical mechanical polishing pads; and, wherein the polishing layer has a polishing surface adapted for polishing the substrate. Also provided is a method of making such polishing layers and for using them to polish a substrate.

10 Claims, 1 Drawing Sheet

CHEMICAL MECHANICAL POLISHING PAD HAVING INTEGRAL IDENTIFICATION FEATURE

The present invention relates generally to the field of chemical mechanical polishing. In particular, the present invention is directed to a chemical mechanical polishing pad having an integral identification feature and methods of making and using the same.

Chemical mechanical planarization, or chemical mechanical polishing (CMP), is a common technique used to polish substrates, such as semiconductor wafers. In conventional CMP using a dual-axis rotary polisher, a wafer carrier, or polishing head, is mounted on a carrier assembly. The polishing head holds the wafer and positions it in contact with a polishing layer of a polishing pad within the polisher. The polishing pad typically exhibits a diameter greater than twice the diameter of the wafer being planarized. During polishing, each of the polishing pad and the wafer is rotated about its respective central axis while the wafer is engaged with the polishing layer. The central axis of the wafer is offset relative to the central axis of the polishing pad by a distance greater than the radius of the wafer such that the rotation of the pad sweeps out a ring-shaped "wafer track", the region on the polishing surface which contacts the wafer during polishing. When the only movement of the wafer is rotational, the width of the wafer track is equal to the diameter of the wafer. However, in some dual-axis polishers, the wafer is oscillated in a plane perpendicular to its axis of rotation. In this case, the width of the wafer track is wider than the diameter of the wafer by an amount that accounts for the displacement due to the oscillation.

To facilitate an increasing number of different polishing processes being implemented in, for example, the manufacture of integrated circuits and other electronic devices, many different chemical mechanical polishing pads have already been developed and more are under active development. The suite of current chemical mechanical polishing pad options includes polishing layers comprising porous and non-porous polymers, films and felts based poromeric materials and a variety of surface modification options (e.g., groove patterns). The various polishing layer options may be combined with various subpad and intermediate layer options, different stack adhesives, window options, etc. Each of these various options has the potential for altering the polishing properties of the resultant chemical mechanical polishing pad. The selection and installation of the proper chemical mechanical polishing pad is important to achieve the desired polishing results. The inadvertent installation of the wrong chemical mechanical polishing pad can result in significant lost time and may cause costly device damage and yield losses. This concern is exacerbated by the fact that many chemical mechanical polishing pads having substantially different polishing properties can have a similar appearance. Accordingly, it is becoming an increasing concern for semiconductor fabrication facility operators to have an effective means to quickly and easily identify chemical mechanical polishing pads.

One approach to facilitating identification of polishing pads is disclosed in U.S. Pat. Nos. 5,533,923 and 5,584,146 to Shamouillan et al. Shamouillan et al. disclose a structure useful as a polishing pad for chemical mechanical polishing, comprising: (a) plurality of conduits; and (b) a matrix of material in contact with and supporting said conduits and shaped to form a polishing pad; wherein, said conduits are constructed from a first material which is different from a second material used as said support matrix, wherein said conduits are positioned within said support matrix in a manner such that longitudinal centerlines of said conduits form an angle principally ranging from about 60° to about 120° with the working surface of said polishing pad and wherein the polishing pad is color coded to identify the chemical compatibility of the pad, so that the user can easily select from his inventory the pad which is compatible with the polishing operation to be performed.

Notwithstanding, there is a continuing need for improved methods of identifying and distinguishing various chemical mechanical polishing pads to reduce the likelihood that the wrong chemical mechanical polishing pad will be installed on a polisher for a given polishing operation and to increase the likelihood that a misoperation event involving the inadvertent installation of the wrong type of chemical mechanical polishing pad is avoided.

In one aspect of the present invention, there is provided a chemical mechanical polishing pad for polishing a substrate selected from a magnetic substrate, an optical substrate and a semiconductor substrate; comprising: a polishing layer having a polishing surface adapted for polishing the substrate and a unique integral identification feature; wherein the unique integral identification feature is non-polish active, wherein the unique integral identification feature comprises at least two visually distinct characteristics, wherein at least one of the at least two visually distinct indicia is a non-color based indicia, wherein one of the at least two visually distinct indicia is a color based indicia, and wherein the at least two visually distinct characteristics are selected to uniquely identify the chemical mechanical polishing pad as a type of chemical mechanical polishing pad selected from a plurality of types of chemical mechanical polishing pads; and, wherein the polishing layer has a polishing surface adapted for polishing the substrate.

In another aspect of the present invention, there is provided a method of making a chemical mechanical polishing pad, comprising: providing an integral plug; providing a mold; providing a flowable chemical mechanical polishing layer precursor material; introducing the flowable chemical mechanical polishing layer precursor material into the mold; introducing the integral plug into the flowable chemical mechanical polishing layer precursor material; reacting the flowable chemical mechanical polishing layer precursor material to form a solidified cake; cutting the solidified cake into a plurality of individual chemical mechanical polishing layers, wherein each individual chemical mechanical polishing layer has a polishing surface and a unique integral identification feature exhibiting at least two visually distinct indicia and wherein the at least two visually distinct indicia are substantially identical for each one of the plurality of chemical mechanical polishing layers; and, wherein the polishing surface is adapted for polishing the substrate.

In another aspect of the present invention, there is provided a method for chemical mechanical polishing of a substrate selected from a magnetic substrate, an optical substrate and a semiconductor substrate; comprising: providing a chemical mechanical polishing apparatus having a platen; providing at least one substrate selected from a magnetic substrate, an optical substrate and a semiconductor substrate; providing at least two polishing operations; providing a plurality of types of chemical mechanical polishing pads, wherein each type of chemical mechanical polishing pad has different polishing properties and a unique integral identification feature to distinguish each type of chemical mechanical polishing pad from the other types of chemical mechanical polishing pads in the plurality of types, wherein the unique integral identification feature is non-polish active, wherein the unique integral identification feature comprises at least two visually distinct indicia, wherein at least one of the at least two visually distinct indicia is a non-color based indicia, wherein one of the at least two visually distinct indicia is a color based indicia, and wherein the at least two visually distinct characteristics are selected to be observable and to uniquely identify each type of chemical mechanical polishing pad in the plurality of types; providing at least two polishing recipes, wherein each polishing recipe corresponds to one of the at least two polishing operations and wherein each polishing recipe includes an identification of the at least two visually distinct indicia for the type of chemical mechanical polishing pad to be used; selecting a polishing operation to be performed from the at least two polishing operations ("the selected polishing operation") and a corresponding polishing recipe ("the selected recipe"); installing onto the platen the type of chemical mechanical polishing pad identified in the selected recipe; observing the unique integral identification feature of the installed chemical mechanical polishing pad and verifying that the at least two visually distinct indicia contained therein correspond with those identified in the selected recipe; and performing the selected polishing operation on the at least one substrate.

DETAILED DESCRIPTION

Figure 1:
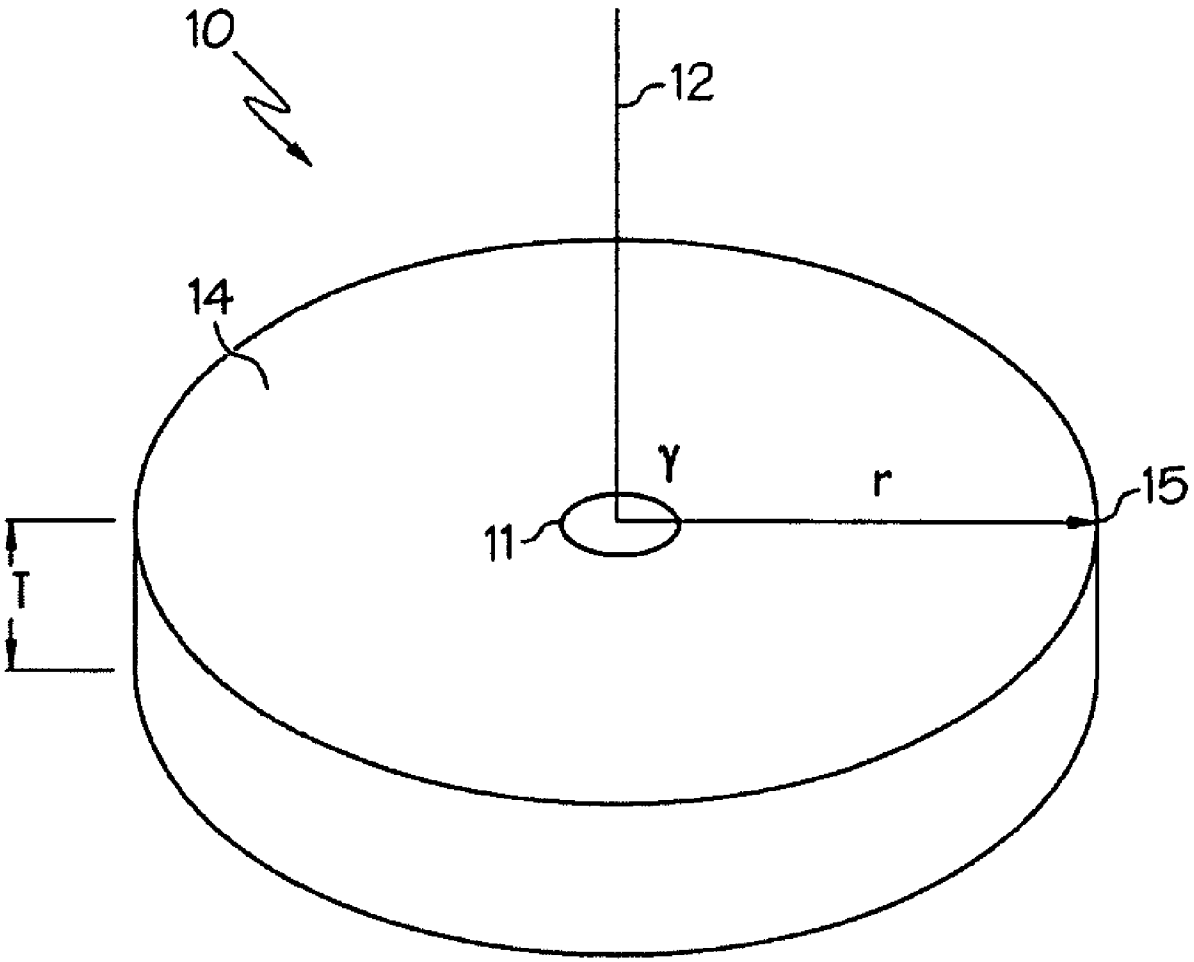
FIG. 1 is a depiction of a perspective top/side view of a chemical mechanical polishing layer of the present invention having a substantially circular cross section.

The term "substantially circular cross section" as used herein and in the appended claims in reference to a chemical mechanical polishing pad or a polishing pad component (e.g., polishing layer 10) means that the longest radius, r, of a cross section from a central axis 12 to an outer periphery 15 of the polishing pad component is ≦20% longer than the shortest radius, r, of the cross section from the central axis 12 to the outer periphery 15. (See FIG. 1).

The term "polishing medium" as used herein and in the appended claims encompasses particle-containing polishing solutions and non-particle-containing solutions, such as abrasive-free and reactive-liquid polishing solutions.

The term "color based indicia" as used herein and in the appended claims means a color of at least part of a unique integral identification feature of a polishing layer that is both detectable by a human observer having normal color vision and distinguishable by a human observer having normal color vision from the color of other color based indicia in the unique integral identification feature and the color(s) exhibited at the polishing surface of the polishing layer (excluding the region of the polishing surface occupied by the unique integral identification feature).

The term "center color based indicia" as used herein and in the appended claims refers to a color indicia that is present at the polishing surface of a polishing layer at the central axis of the polishing layer.

The term "colorfast" as used herein and in the appended claims in reference to a color indicia means that the color of the indicia will not bleed or fade during polishing.

The term "observable" as used herein and in the appended claims in reference to a given visually distinct indicia of a unique integral identification feature means that a human observer (including one having a color vision impairment) will be able to see and distinguish the indicia from other visually distinct indicia in the unique integral identification feature and the remainder of the surrounding polishing surface.

The term "poly(urethane)" as used herein and in the appended claims encompasses (a) polyurethanes formed from the reaction of (i) isocyanates and (ii) polyols (including diols); and, (b) poly(urethane) formed from the reaction of (i) isocyanates with (ii) polyols (including diols) and (iii) water, amines or a combination of water and amines.

The chemical mechanical polishing pad of the present invention contains a unique integral identification feature to facilitate unique identification of the chemical mechanical polishing pad by polishing pad type (e.g., IC1000® available from Rohm and Haas) and to distinguish it from other types of chemical mechanical polishing pads (e.g., VisionPad® 5000 available from Rohm and Haas). It is important to note that, according to some reports, as much as eight percent of the male population and less than one percent of the female population has some form of color vision impairment. Color vision impairments alter the way that colors are perceived by the impaired individual. Depending on the type and severity of the color vision impairment, colors that are easily differentiable to individuals having normal color vision may be indistinguishable for the color vision impaired individual. To facilitate the manual installation of chemical mechanical polishing pads onto a chemical mechanical polishing apparatus and to alleviate potential concerns associated with simple color identification by human operators, the present invention implements a combination of color and non-color based visual indicia to identify different types of chemical mechanical polishing pads for human observers, including those individuals having a color vision impairment.

The unique integral identification feature of the present invention is a non-polish active feature. That is, the unique integral identification feature exhibits no inherent physical or chemical effect on polishing that is different from the remainder of the polishing surface. Preferably, the portion of the polishing layer occupied by the unique integral identification feature is outside the wafer track. Notwithstanding, contact between the unique integral identification feature and the substrate during polishing is not precluded.

The unique integral identification feature comprises at least two visually distinct characteristics observable on the polishing surface throughout the useful life of the chemical mechanical polishing pad, wherein at least one of the at least two visually distinct characteristics is a color based indicia, wherein at least one of the at least two visually distinct characteristics is a non-color indicia and wherein the at least two visually distinct characteristics are selected to uniquely identify a chemical mechanical polishing pad by type of chemical mechanical polishing pad to a human observer (including those having color vision impairments).

The non-color indicia is a two-dimensional shape observable on the polishing surface throughout the useful life of the chemical mechanical polishing pad. Preferred two-dimensional shapes are selected from a polygon, a reuleaux polygon, a circle, an oval, an ellipse, a lens, a lune, a superellipse, a squoval, a squircle, a quartic plane curve, a fractal, a symbol (e.g., letters, characters, numbers) and a combination of at least two of the foregoing shapes. The two-dimensional shapes can be in outline form with the outer periphery of the shape having a color different from that of the remainder of the polishing surface. The two-dimensional shapes can also be in filled form, wherein the entire two-dimensional shape is filled in with a given color different from the remainder of the polishing surface. When combinations of two-dimensional shapes are used, they can be adjacent or overlapping. When the combinations are overlapping, the overlapped portion of the shapes can be a different color from the non-overlapped portions.

Non-color indicia suitable for use with the present invention are observable on the polishing surface throughout the useful life of the chemical mechanical polishing pad. Preferably, the non-color indicia is a two-dimensional shape selected from a polygon, a reuleaux polygon, a circle, an oval, an ellipse, a lens, a lune, a superellipse, a squoval, a squircle, a quartic plane curve and a symbol. More preferably, the non-color indicia is a two-dimensional shape selected from a reuleaux triangle, a triangle, a circle, a reuleaux square, a squircle, a squoval, a square and a symbol. Still more preferably, the non-color indicia is a two-dimensional shape selected from a reuleaux triangle, a triangle, a circle, a reuleaux square, a squircle, a squoval and a square. Most preferably, the non-color indicia is a circle.

The non-color indicia can, optionally, comprise at least two non-color indicia observable on the polishing surface throughout the useful life of the chemical mechanical polishing pad. The at least two non-color indicia can be the same or different shapes (e.g., two adjacent circular shaped indicia; or a circular shaped indicia inside a square shaped indicia). The non-color indicia can be in outline form with the border of the non-color indicia in one color and the center of the indicia in another. The non-color indicia can be in a filled form with the whole non-color indicia in one color. The at least two non-color indicia can overlap one another. Preferably, the non-overlapping portion of at least one of the at least two non-color indicia can be a different color from the overlapped portion. Preferably, the at least two non-color indicia are selected from a combination of two-dimensional shapes observable on the polishing surface throughout the useful life of the chemical mechanical polishing pad. The at least two non-color indicia can each be selected from a polygon, a reuleaux polygon, a circle, an oval, an ellipse, a lens, a lune, a superellipse, a squoval, a squircle, a quartic plane curve, a fractal, and a symbol. Preferably, the at least two non-color indicia comprise a polygon, a reuleaux polygon, a circle, an oval, an ellipse, a lens, a lune, a superellipse, a squoval, a squircle, a quartic plane curve, a fractal, or a symbol encompassed within a polygon, a reuleaux polygon, a circle, an oval, an ellipse, a lens, a lune, a superellipse, a squoval, a squircle, a quartic plane curve, a fractal or a symbol. More preferably, the at least two non-color indicia are selected from a reuleaux triangle, a triangle, a circle, a reuleaux square, a squircle, a squoval, a square or a symbol encompassed within a reuleaux triangle, a triangle, a circle, a reuleaux square, a squircle, a squoval, a square or a symbol. Most preferably, the at least two non-color indicia are selected from a reuleaux triangle, a triangle, a circle, a reuleaux square, a squircle, a squoval, a square or a symbol encompassed within a circle.

The color based indicia is a color that is both detectable by a human observer having normal color vision and distinguishable by a human observer having normal color vision from the color of other color based indicia of which the unique integral identification feature is comprised and from the color(s) exhibited at the polishing surface of the polishing layer (excluding the region of the polishing surface occupied by the unique integral identification feature) throughout the useful life of the chemical mechanical polishing pad.

The at least one color based indicia can, optionally, comprise at least two color based indicia. The at least two color based indicia can be selected to be observable as two distinct indicia by a human observer (including individuals having a color vision impairment). Various tools have been developed to assist in the selection of such observable color based indicia. For example, "ColorBrewer" developed by Cynthia Brewer and Mark Harrower (http://www.personal.psu.edu/cab38/ColorBrewer/ColorBrewer.html).

The chemical mechanical polishing pad of the present invention comprises a polishing layer 10 having a unique integral identification feature 11, a polishing surface 14, a central axis 12 and a thickness T, which is adapted for rotation about the central axis. (See FIG. 1). Preferably, the polishing layer 10 of the chemical mechanical polishing pad is in a plane substantially perpendicular to the central axis 12 (i.e., ±10° from perpendicular). Preferably, the polishing layer 10 is adapted for rotation in a plane that is at an angle, γ, of 85 to 95° to the central axis 12, more preferably of 90° from the central axis 12. Preferably, the polishing layer 10 has a polishing surface 14 that has a substantially circular cross section perpendicular to the central axis 12. The longest radius, r, for a cross section of the polishing surface 14 perpendicular to the central axis 12 is preferably ≦20% longer than the shortest radius, r, for the cross section.

Optionally, the chemical mechanical polishing pad comprises a polishing layer having a polishing surface, wherein the polishing layer has a substantially circular cross section and wherein the at least one color based indicia includes a center color based indicia. The center color based indicia encompasses a region of the polishing surface that extends ≦30 mm, preferably 1 mm to 30 mm, more preferably 2 mm to 20 mm, most preferably 2 mm to 10 mm from the central axis of the polishing layer. The center color based indicia comprises a color filled circle on the polishing surface. The unique integral identification feature is preferably located in a region that extends ≦30 mm, more preferably 1 mm to 30 mm, still more preferably 2 mm to 20 mm, most preferably 2 mm to 10 mm from the central axis of the polishing layer and the center color based indicia of the unique integral identification feature occupies a region of the polishing layer extending ≦30 mm, preferably 1 mm to 30 mm, more preferably 2 mm to 20 mm, most preferably 2 mm to 10 mm from the central axis of the polishing layer.

Optionally, the chemical mechanical polishing pad comprises a polishing layer having a polishing surface, wherein the polishing layer has a substantially circular cross section, wherein the color based indicia is a center color based indicia, wherein the center color based indicia occupies a region ≦30 mm from a central axis and wherein the color based indicia comprises a reactive polymeric colorant that comprises chromophores chemically bound to a polyol.

Notwithstanding the use of a combination of color and non-color based visual indicia to facilitate identification of different types of chemical mechanical polishing pads for human observers (including those with color vision impairments), a center color based indicia of the unique integral identification feature is preferably selected to be sufficient by itself to uniquely identify a chemical mechanical polishing pad as a given type of chemical mechanical polishing pad for the purpose of machine sensing. A variety of color sensors are commercially available that are suitable for use with the present invention. Some examples of commercially available color sensors include the PCS-II USB-Connected Perceptive Color Sensor (reported to recognize up to 255 user defined colors with a color resolution of <1 ΔE) available from Saelig Pittsford, N.Y. and the X-Rite® Vericolor® Non-contact color sensors (reported to store information on up to 50 active colors with a color resolution of 0.25 ΔE) commercially available from JR Technical Services Inc., Oakville, Ontario, Canada.

The chemical mechanical polishing pad comprises a polishing layer having a polishing surface, wherein the polishing layer preferably has a substantially circular cross section with a central axis. The unique integral identification feature is optionally located in a region ≦30 mm, preferably 1 mm to 30 mm, more preferably 2 mm to 20 mm, most preferably 2 mm to 10 mm from the central axis of the polishing layer. The unique integral identification feature preferably exhibits a substantially circular cross section parallel to and coincident with the polishing surface. The substantially circular cross section preferably has an average radius of ≦30 mm, more preferably 1 mm to 30 mm, still more preferably 2 mm to 20 mm, most preferably 2 mm to 10 mm from the central axis of the polishing layer.

The unique integral identification feature exhibits an average density and an average hardness comparable to the average density and the average hardness of the remainder of the polishing layer comprising the unique integral identification feature. The unique integral identification feature optionally has an average density within ±10%; preferably ±5%; more preferably ±2%; still more preferably ±1% of the average density of the remainder of the polishing layer comprising the unique integral identification feature. The unique integral identification feature preferably has (a) an average density within ±10%; preferably ±5%; more preferably ±2%; still more preferably ±1% of the average density of the remainder of the polishing layer comprising the unique integral identification feature and (b) a Shore D hardness within ±10%; preferably ±5%; more preferably ±2%; still more preferably ±1% of the average Shore D hardness of the remainder of the polishing layer comprising the unique integral identification feature.

The unique integral identification feature optionally is embodied in an integral plug that is incorporated into the polishing layer and extends through the entire thickness of the polishing layer. The integral plug defines a volume having a height, a top surface and a bottom surface; wherein the top surface is coincident with the polishing surface of the polishing layer and the bottom surface is coincident with a non-polishing surface of the polishing layer that is parallel with the polishing surface. Preferably, the integral plug exhibits a cross section parallel to the top surface that is the same at all points along the height of the integral plug. The cross section can be selected from a polygon, a reuleaux polygon, a circle, an oval, an ellipse, a lens, a lune, a superellipse, a squoval, a squircle, a quartic plane curve and a symbol. Preferably, the cross section is selected from a reuleaux triangle, a triangle, a circle, a reuleaux square, a squircle, a squoval, a square and a symbol. Preferably, the integral plug has a three dimensional shape selected from a right circular cylinder, a right non-circular cylinder (e.g., an elliptic cylinder), a cuboid (e.g., a right rectangular prism) and a polyhedron (e.g., a uniform prism). More preferably, the integral plug is a right circular cylinder.

The integral plug can be translucent, transparent, opaque, or a combination thereof (e.g., the integral plug can comprise an opaque portion and a translucent portion). Preferably, the integral plug is translucent, opaque or a combination thereof. Most preferably, the integral plug is opaque.

The integral plug can comprise a polymer selected from a poly(urethane), a polysulfone, a polyether sulfone, a nylon, a polyether, a polyester, a polystyrene, an acrylic polymer, a polyurea, a polyamide, a polyvinyl chloride, a polyvinyl fluoride, a polyethylene, a polypropylene, a polybutadiene, a polyethylene imine, a polyacrylonitrile, a polyethylene oxide, a polyolefin, a poly(alkyl)acrylate, a poly(alkyl)methacrylate, a polyether imide, a polyketone, an epoxy, a silicone, a polymer of an ethylene propylene diene monomer, a protein, a polysaccharide, a polyacetate and a combination of at least two of the foregoing. Preferably, the integral plug comprises a poly(urethane), a polyvinyl chloride or a combination of a poly(urethane) and a polyvinyl chloride. More preferably, the integral plug comprises a poly(urethane). Still more preferably, the integral plug comprises a polyurethane.

The integral plug optionally further comprises at least one coloring additive. The integral plug can comprise at least two coloring additives. Different portions of the integral plug can optionally comprise different concentrations of the at least one coloring additive.

Coloring additives suitable for use with the present invention include materials that can impart a color to the integral plug, that are compatible with the other materials used in the manufacture of the chemical mechanical polishing pad, and that do not negatively affect the polishing operations for which the chemical mechanical polishing pad into which they are incorporated are designed. Preferred coloring additives include reactive polymeric colorants that comprise chromophores chemically bound to a polyol (e.g., Reactint® colorants commercially available from Milliken Chemicals).

The integral plug optionally comprises reactive moieties on the surface that react with the flowable chemical mechanical polishing layer precursor material such that the integral plug is both physically and chemically bonded in the polishing layer into which it is incorporated.

The integral plug can be molded in the desired shape for incorporation into a chemical mechanical polishing pad.

The integral plug can be machined or shaped to provide the desired shape for incorporation into a chemical mechanical polishing pad.

The method of making a chemical mechanical polishing pad of the present invention, comprises: providing an integral plug; providing a mold; providing a flowable chemical mechanical polishing layer precursor material; introducing the flowable chemical mechanical polishing layer precursor material into the mold; introducing the integral plug into the flowable chemical mechanical polishing layer precursor material; reacting the flowable chemical mechanical polishing layer precursor material to form a solidified cake; cutting the solidified cake into a plurality of individual chemical mechanical polishing layers, wherein each individual chemical mechanical polishing layer has a polishing surface and a unique integral identification feature exhibiting at least two visually distinct indicia and wherein the at least two visually distinct indicia are substantially identical for each one of the plurality of chemical mechanical polishing layers; and, wherein the polishing surface is adapted for polishing a substrate. Preferably, the portion of the integral plug contained in each individual chemical mechanical polishing layer is a unique integral identification feature that exhibits a cross section parallel to and coincident with the polishing surface, wherein the cross section exhibits at least two visually distinct characteristics, wherein at least one of the at least two visually distinct characteristics is a non-color based indicia, wherein at least one of the at least two visually distinct characteristics is a color based indicia, and wherein the at least two visually distinct characteristics are selected to uniquely identify to a human observer (including individuals having a color vision impairment) a chemical mechanical polishing pad containing the polishing layer as a type of chemical mechanical polishing pad from a plurality of types of chemical mechanical polishing pads. The color based indicia is optionally selected such that the color based indicia alone can uniquely identify the chemical mechanical polishing pad by type to at least one of a human observer with normal color vision and a photoelectric color sensor. The substrate can be selected from a magnetic substrate, an optical substrate and a semiconductor substrate. Preferably, the substrate is a semiconductor substrate. More preferably, the substrate is a semiconductor wafer.

The flowable chemical mechanical polishing layer precursor material polymerizes to form a material selected from poly(urethane), polysulfone, polyether sulfone, nylon, polyether, polyester, polystyrene, acrylic polymer, polyurea, polyamide, polyvinyl chloride, polyvinyl fluoride, polyethylene, polypropylene, polybutadiene, polyethylene imine, polyacrylonitrile, polyethylene oxide, polyolefin, poly(alkyl) acrylate, poly(alkyl)methacrylate, polyamide, polyether imide, polyketone, epoxy, silicone, polymer formed from ethylene propylene diene monomer, protein, polysaccharide, polyacetate and a combination of at least two of the foregoing. Preferably, the flowable chemical mechanical polishing layer precursor material polymerizes to form a material comprising a poly(urethane). More preferably, the flowable chemical mechanical polishing layer precursor material polymerizes to form a material comprising a polyurethane. Most preferably, the flowable chemical mechanical polishing layer precursor material polymerizes to form a polyurethane.

The flowable chemical mechanical polishing layer precursor material optionally further comprises a plurality of microelements. Preferably, the plurality of microelements is uniformly dispersed within the flowable chemical mechanical polishing layer precursor material. The plurality of microelements can be selected from entrapped gas bubbles, hollow core polymeric materials, liquid filled hollow core polymeric materials, water soluble materials and an insoluble phase material (e.g., mineral oil). Preferably, the plurality of microelements comprises hollow core polymeric materials uniformly distributed throughout the flowable chemical mechanical polishing layer precursor material. More preferably, the plurality of microelements comprises a hollow core copolymer of acrylonitrile and vinylidene chloride (e.g., Expancel® available from Akzo Nobel) uniformly distributed throughout the flowable chemical mechanical polishing layer precursor material. A problem associated with pouring flowable chemical mechanical polishing layer precursor materials containing such microelements around an integral plug, is that the material on the outer flow front begins to react and increase in viscosity as it fills the mold causing inconsistencies in the concentration of the polymeric microelements in the material surrounding the integral plug and poor mixing of the material at the fronts after flowing around the restriction. Such inconsistencies cause imperfections in the finished cake that have been observed to negatively impact the polishing performance. It has been found, however, that these inconsistencies can be avoided by pouring the flowable precursor material into the mold first and then inserting the integral plug into the poured material.

Alternatively, the method of making a chemical mechanical polishing pad of the present invention, comprises: providing a solidified cake having a hole; providing a flowable integral plug precursor material; introducing the flowable integral plug precursor material into the hole; reacting the flowable integral plug precursor material to form a solidified integral plug within the cake; cutting the solidified cake into a plurality of individual chemical mechanical polishing layers, wherein each individual chemical mechanical polishing layer has a polishing surface and a unique integral identification feature exhibiting at least two visually distinct indicia and wherein the at least two visually distinct indicia are substantially identical for each one of the plurality of chemical mechanical polishing layers; and, wherein the polishing surface is adapted for polishing a substrate. The solidified cake optionally comprises reactive moieties on the surface that react with the flowable integral plug precursor material such that the solidified integral plug is both physically and chemically bonded in the polishing layer into which the solidified integral plug is incorporated. Optionally, the solidified integral plug can comprise two or more portions, wherein each portion is formed by providing multiple holes in the cake, filling the holes with a flowable integral plug precursor material and reacting the precursor material to form a solidified portion of the integral plug. Optionally, each solidified portion can comprise a different color based indicia. Optionally, two or more of the multiple holes provided in the cake intersect. Preferably, the portion of the integral plug contained in each individual chemical mechanical polishing layer is a unique integral identification feature that exhibits a cross section parallel to and coincident with the polishing surface, wherein the cross section exhibits at least two visually distinct characteristics, wherein at least one of the at least two visually distinct characteristics is a non-color based indicia, wherein at least one of the at least two visually distinct characteristics is a color based indicia, and wherein the at least two visually distinct characteristics are selected to uniquely identify to a human observer (including individuals having a color vision impairment) a chemical mechanical polishing pad containing the polishing layer as a type of chemical mechanical polishing pad from a plurality of types of chemical mechanical polishing pads. The color based indicia is optionally selected such that the color based indicia alone can uniquely identify the chemical mechanical polishing pad by type to at least one of a human observer with normal color vision and a photoelectric color sensor. The substrate can be selected from a magnetic substrate, an optical substrate and a semiconductor substrate. Preferably, the substrate is a semiconductor substrate. More preferably, the substrate is a semiconductor wafer.

In some embodiments, providing a solidified cake having a hole, comprises: providing a mold; providing a flowable chemical mechanical polishing layer precursor material; introducing the flowable chemical mechanical polishing layer precursor material into the mold; reacting the flowable chemical mechanical polishing layer precursor material to form a solidified cake; and, making a hole in the solidified cake. Any conventional method for making a hole in the solidified that does not degrade the polishing properties of the solidified cake material can be used (e.g., drilling, die cutting, milling, laser cutting, knife cutting).

In some embodiments, providing a solidified cake having a hole, comprises: providing a mold; providing a flowable chemical mechanical polishing layer precursor material; providing a mold insert; introducing the flowable chemical mechanical polishing layer precursor material into the mold; inserting the mold insert into the mold; reacting the flowable chemical mechanical polishing layer precursor material to form a solidified cake; and, separating the mold insert from the solidified cake leaving a hole in the solidified cake. The mold insert can be inserted in the mold before introduction of the flowable chemical mechanical polishing precursor material into the mold. Preferably, the mold insert is inserted into the mold after the flowable chemical mechanical polishing precursor material has been introduced into the mold.

The method for chemical mechanical polishing of a substrate selected from a magnetic substrate, an optical substrate and a semiconductor substrate; comprises: providing a chemical mechanical polishing apparatus having a platen; providing at least one substrate selected from a magnetic substrate, an optical substrate and a semiconductor substrate; providing at least two polishing operations; providing a plurality of types of chemical mechanical polishing pads, wherein each type of chemical mechanical polishing pad has different polishing properties and a unique integral identification feature to distinguish each type of chemical mechanical polishing pad from the other types of chemical mechanical polishing pads in the plurality of types, wherein the unique integral identification feature is non-polish active, wherein the unique integral identification feature comprises at least two visually distinct indicia, wherein at least one of the at least two visually distinct indicia is a non-color based indicia, wherein one of the at least two visually distinct indicia is a color based indicia, and wherein the at least two visually distinct characteristics are selected to be observable and to uniquely identify each type of chemical mechanical polishing pad in the plurality of types; providing at least two polishing recipes, wherein each polishing recipe corresponds to one of the at least two polishing operations and wherein each polishing recipe includes an identification of the at least two visually distinct indicia for the type of chemical mechanical polishing pad to be used; selecting a polishing operation to be performed from the at least two polishing operations ("the selected polishing operation") and a corresponding polishing recipe ("the selected recipe"); installing onto the platen the type of chemical mechanical polishing pad identified in the selected recipe ("the first installed polishing pad"); observing the unique integral identification feature of the first installed polishing pad and verifying that the at least two visually distinct indicia contained therein correspond with those identified in the selected recipe; and performing the selected polishing operation on the at least one substrate. The method may optionally further comprise: selecting a subsequent polishing operation from the at least two polishing operations ("the subsequent polishing operation") and a corresponding subsequent polishing recipe ("the subsequent recipe"); installing onto the platen the type of chemical mechanical polishing pad identified in the subsequent recipe ("the subsequently installed polishing pad"); observing the unique integral identification feature of the subsequently installed polishing pad and verifying that the at least two visually distinct indicia contained therein correspond with those identified in the subsequent recipe; and performing the subsequent polishing operation on the at least one substrate. The multiple polishing operations can be performed using a single chemical mechanical polishing apparatus, wherein the multiple polishing operations are performed on the same substrate using at least two different types of chemical mechanical polishing pads (e.g., multiple polishing operations on a given semiconductor wafer). The multiple polishing operations can be performed on the same chemical mechanical polishing apparatus, wherein the multiple polishing operations are performed on different substrates and wherein at least two different types of chemical mechanical polishing pads are used. Also, multiple chemical mechanical polishing apparatuses can be used. When multiple apparatuses are used, each separate apparatus can be used to perform the same type of polishing operation (s) or they can be set up to perform different types of polishing operations. Preferably, the substrate is a semiconductor substrate. More preferably, the substrate is a semiconductor wafer.

The method for chemical mechanical polishing of a substrate selected from a magnetic substrate, an optical substrate and a semiconductor substrate; comprises: providing a chemical mechanical polishing apparatus having a platen; providing at least one substrate selected from a magnetic substrate, an optical substrate and a semiconductor substrate; providing at least two polishing operations; providing at least two types of chemical mechanical polishing pads, wherein each type of chemical mechanical polishing pad has different polishing properties and a unique integral identification feature, wherein the unique integral identification feature is non-polish active, wherein the unique integral identification feature comprises at least two visually distinct indicia, wherein at least one of the at least two visually distinct indicia is a non-color based indicia, wherein one of the at least two visually distinct indicia is a center color based indicia, wherein the at least two visually distinct characteristics are selected to be observable and to uniquely identify each type of chemical mechanical polishing pad in the plurality of types, and wherein the center color based indicia is unique for each type of chemical mechanical polishing pad in the plurality of types; providing at least two polishing recipes, wherein each polishing recipe corresponds to one of the at least two polishing operations and wherein each polishing recipe includes an identification of the at least two visually distinct indicia for the type of chemical mechanical polishing pad to be used, including the identification of the center color based indicia; providing a control system for controlling the chemical mechanical polishing apparatus; providing a color sensor capable of recognizing and distinguishing the center color based indicia for each type of chemical mechanical polishing pad in the plurality of types; selecting the polishing operation to be performed ("the selected polishing operation") along with the corresponding polishing recipe ("the selected recipe"); installing a chemical mechanical polishing pad of the type of chemical mechanical polishing pad identified in the selected recipe onto the platen ("the first installed pad"); sensing the color of the center color based indicia for the first installed pad using the color sensor and providing a color input to the control system; automatically verifying that the first installed pad is of the type of chemical mechanical polishing pad identified in the selected recipe by comparing the color input with the identified center color based indicia in the selected recipe; and performing the selected polishing operation on the at least one substrate. The method may optionally further comprise: providing an interlock, wherein the interlock prevents the chemical mechanical polishing apparatus from performing the selected polishing operation if the color input does not correspond with the identified center color based indicia in the selected recipe. The method may optionally further comprise: selecting another polishing operation from the at least two polishing operations ("the subsequent polishing operation") and a corresponding subsequent polishing recipe ("the subsequent recipe"); installing onto the platen the type of chemical mechanical polishing pad identified in the subsequent recipe ("the subsequently installed pad"); automatically verifying that the color of the center color based indicia for the subsequently installed pad for the subsequent polishing operation corresponds with the identified center color based indicia in the subsequent recipe using the sensor; performing the subsequent polishing operation on the at least one substrate if the type of chemical mechanical polishing pad identified in the subsequent recipe is installed. The method may optionally further comprise: observing the unique integral identification feature of the installed chemical mechanical polishing pad and verifying that the at least two visually distinct indicia contained therein correspond with those identified in the recipe for the polishing operation to be performed; and performing the polishing operation on the at least one substrate, provided that the type of chemical mechanical polishing pad installed is of the type identified in the recipe for the polishing operation to be performed. Multiple polishing operations may be performed using the chemical mechanical polishing apparatus, wherein the multiple polishing operations are performed on the same substrate using at least two different types of chemical mechanical polishing pads (e.g., multiple polishing operations on a given semiconductor wafer). Preferably, multiple polishing operations are performed using the chemical mechanical polishing apparatus, wherein the multiple polishing operations are performed on different substrates and wherein at least two different types of chemical mechanical polishing pads are used. Preferably, the substrate is a semiconductor substrate. More preferably, the substrate is a semiconductor wafer.

Some embodiments of the present invention will now be described in detail in the following Examples.

EXAMPLE

A cylindrical center color based indicia was prepared by mixing 50 g of a toluene diisocyanate terminated polyether prepolymer heated to 80° C. with 1.4 g of hollow core polymeric microelements (i.e., Expancel®). To the resultant mixture was then added 11.9 g of molten 4,4'-methylene-bis(2-chloroaniline) and 0.13 g of Reactint® Violet X80LT. The final mixture was then poured into a cylindrical mold and allowed to gel and cool to room temperature. The cylindrical center color based indicia was then removed from the mold. The cylindrical center color based indicia was then inserted into a cake comprising a mixture of toluene diisocyanate terminated polyether prepolymer, hollow core polymeric microelements and 4,4'-methylene-bis(2-chloroaniline) while the cake was still flowable. The cake was then allowed to cure. The cured cake was then skived into multiple polishing layers, each comprising a violet center color based indicia having a circular cross section.

We claim:

1. A method for chemical mechanical polishing of a substrate selected from a magnetic substrate, an optical substrate and a semiconductor substrate; comprising:

providing a chemical mechanical polishing apparatus having a platen;

providing at least one substrate selected from a magnetic substrate, an optical substrate and a semiconductor substrate;

providing at least two polishing operations;

providing a plurality of types of chemical mechanical polishing pads, wherein each type of chemical mechanical polishing pad has different polishing properties and a unique integral identification feature to distinguish each type of chemical mechanical polishing pad from the other types of chemical mechanical polishing pads in the plurality of types, wherein the unique integral identification feature is non-polish active, wherein the unique integral identification feature comprises at least two visually distinct characteristics, wherein at least one of the at least two visually distinct characteristics is a non-color based indicia, wherein one of the at least two visually distinct characteristics is a color based indicia, and wherein the at least two visually distinct characteristics are selected to the observable and to uniquely identify each type of chemical mechanical polishing pad in the plurality of types;

providing at least two polishing recipes, wherein each polishing recipe corresponds to one of the at least two polishing operations and wherein each polishing recipe includes an identification of the at least two visually distinct characteristics for the type of chemical mechanical polishing pad to be used;

selecting a polishing operation to be performed from the at least two polishing operations ("the selected polishing operation") and a corresponding polishing recipe ("the selected recipe");

installing onto the platen the type of chemical mechanical polishing pad identified in the selected recipe;

observing the unique integral identification feature of the installed chemical mechanical polishing pad and verifying that the at least two visually distinct characteristics contained therein correspond with those identified in the selected recipe; and performing the selected polishing operation on the at least one substrate.

2. A chemical mechanical polishing pad for polishing a substrate selected from a magnetic substrate, an optical substrate and a semiconductor substrate; comprising:

a polishing layer having a polishing surface adapted for polishing the substrate and a unique integral identification feature; and, wherein the unique integral identification feature is non-polish active, wherein the unique integral identification feature comprises at least two visually distinct characteristics, wherein at least one of the at least two visually distinct characteristics is a non-color based indicia, wherein one of the at least two visually distinct characteristics is a color based indicia, wherein the at least two visually distinct characteristics are selected to uniquely identify the chemical mechanical polishing pad as a type of chemical mechanical polishing pad selected from a plurality of types of chemical mechanical polishing pads, and wherein the unique integral identification feature comprises at least two visually distinct characteristics observable on the polishing surface throughout the useful life of the chemical mechanical polishing pad.

3. The chemical mechanical polishing pad of claim 2, wherein the unique integral identification feature has a cross-section parallel to and coincident with the polishing surface, wherein the cross-section is selected from a polygon, a reuleaux polygon, a circle, an oval, an ellipse, a lens, a lune, a superellipse, a squoval, a squircle, a quartic plane curve, a symbol.

4. The chemical mechanical polishing pad of claim 2, wherein the unique integral identification feature extends through the entire thickness of the polishing layer.

5. The chemical mechanical polishing pad of claim 2, wherein the unique integral identification feature is outside the polishing track.

6. The chemical mechanical polishing pad of claim 2, wherein the unique integral identification feature has an average density within ±10% of the average density of the remainder of the polishing layer comprising the unique integral identification feature.

7. The chemical mechanical polishing pad of claim 2, wherein the unique integral identification feature has an average density within ±10% of the average density of the remainder of the polishing layer and a Shore D hardness within ±10% of the average Shore D hardness of the remainder of the polishing layer.

8. The chemical mechanical polishing pad of claim 2, wherein the polishing layer has a substantially circular cross section with a central axis and wherein the unique integral identification feature is located in a region ≦30 mm from the central axis.

9. The chemical mechanical polishing pad of claim 8, wherein the color based indicia is a center color based indicia, wherein the center color based indicia occupies a region ≦30 mm from a central axis and wherein the color based indicia comprises a reactive polymeric colorant that comprises chromophores chemically bound to a polyol.

10. A method of making a chemical mechanical polishing pad, comprising:

providing an integral plug;

providing a mold;

providing a flowable chemical mechanical polishing layer precursor material; introducing the flowable chemical mechanical polishing layer precursor material into the mold; introducing the integral plug into the flowable chemical mechanical polishing layer precursor material;

reacting the flowable chemical mechanical polishing layer precursor material to form a solidified cake;

cutting the solidified cake into a plurality of individual chemical mechanical polishing layers, wherein each individual chemical mechanical polishing layer has a polishing surface and a portion of the integral plug; wherein the portion of the integral plug contained in each individual chemical mechanical polishing layer is the unique integral identification feature that exhibits a cross section parallel to and coincident with the polishing surface, wherein the cross section exhibits at least two visually distinct characteristics, wherein at least one of the at least two visually distinct characteristics is a non-color based indicia, wherein at least one of the at least two visually distinct characteristics is a color based indicia, and wherein the at least two visually distinct characteristics are selected to uniquely identify to a human observer a chemical mechanical polishing pad containing the polishing layer as a type of chemical mechanical polishing pad from a plurality of types of chemical mechanical polishing pads; and, wherein the polishing surface is adapted for polishing the substrate.

* * * * *